United States Patent [19]

Cianfanelli et al.

[11] Patent Number: 4,769,857

[45] Date of Patent: Sep. 13, 1988

[54] INTEGRAL HELMET FITTED WITH A CHIN PIECE WHICH MAY BE LIFTED BY FORWARD SHIFTING AND SWINGING MOVEMENTS

[76] Inventors: Marco Cianfanelli, Via della Nave a Rovezzano 1; Alberto Lapucci, Via S. Ammirato, 70; Cesare Sordi, Via L. Bardelli 14, all of Firenze, Italy

[21] Appl. No.: 83,367

[22] Filed: Aug. 10, 1987

[30] Foreign Application Priority Data

Sep. 2, 1986 [IT] Italy ..... 21568 A/86

[51] Int. Cl.[4] ..... A42B 3/02

[52] U.S. Cl. ..... 2/424; 2/421

[58] Field of Search ..... 2/6, 424, 421, 10

[56] References Cited

U.S. PATENT DOCUMENTS 4,247,960 2/1981 Nava ..... 2/10 X
4,553,270 11/1985 Hoffmann ..... 2/6 X
4,641,382 2/1987 Gessalin ..... 2/6 X
4,689,836 9/1987 Vitaloni ..... 2/424

*Primary Examiner*—Stanley N. Gilreath
*Assistant Examiner*—Thomas R. Hannon
*Attorney, Agent, or Firm*—Harness, Dickey & Pierce

[57] ABSTRACT

The chin protecting piece (10) is apt to secure the helmet to the wearer's head, by constrainment under the jaw, through a padding (30).

The chin piece can be rotated upwardly to facilitate introduction on or removal of the helmet from the wearer's head by forward shifting and swinging movements or vice versa, as it is secured to the helmet by pins (14) running in an "L" shaped slot (16) in the side walls of the helmet itself.

The movement of the chin piece is independent from that of the vizor which is hinged on pins (8) and may be lifted as required by the wearer.

The chin piece remains locked in its lowered position by a snap action device (34–40).

8 Claims, 3 Drawing Sheets

FIG. 1.
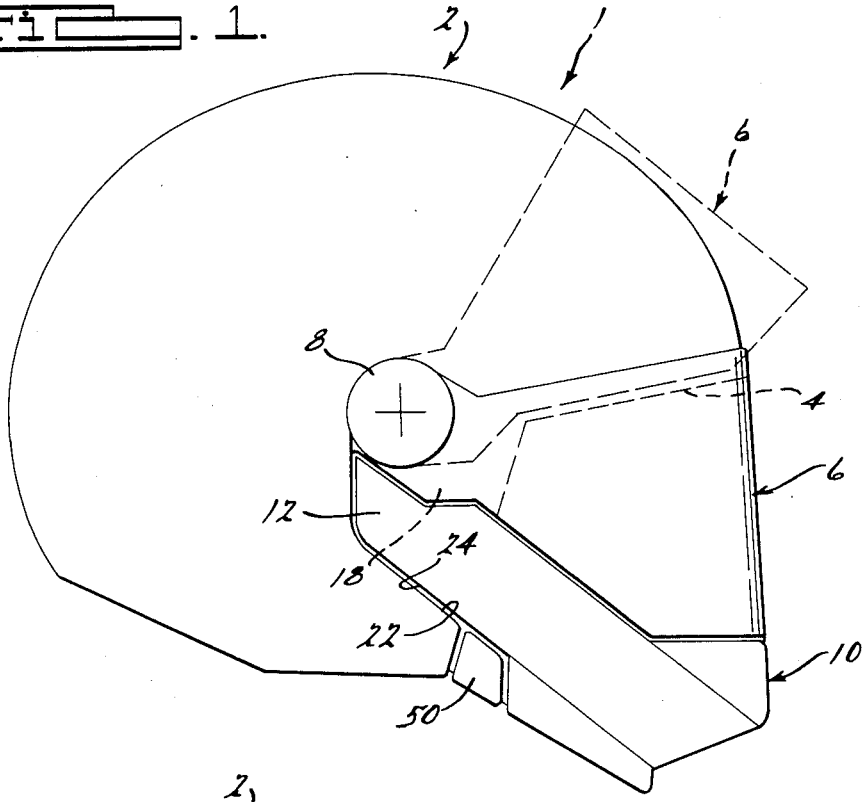
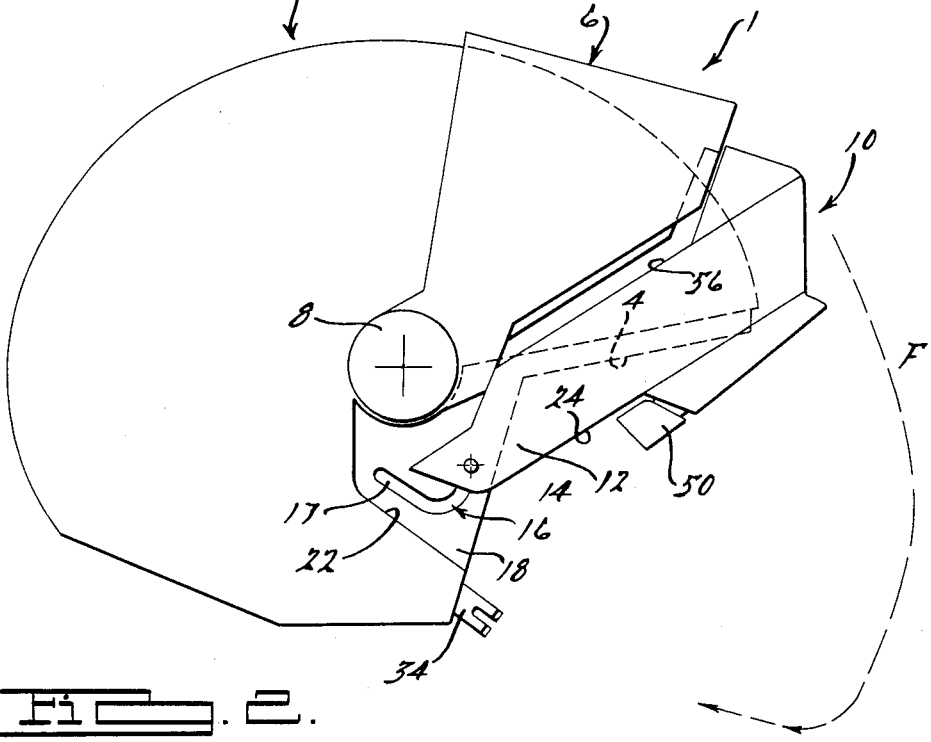
FIG. 2.

INTEGRAL HELMET FITTED WITH A CHIN PIECE WHICH MAY BE LIFTED BY FORWARD SHIFTING AND SWINGING MOVEMENTS

DESCRIPTION

This invention relates to an integral helmet equipped with a single chin piece, which may be lifted by forward shifting and swinging movements to facilitate wearing or removal on or from the wearer's head.

As it is known, various types of helmets for the protection of motorcyclists' heads have been developed heretofore.

These can be divided in two general classes, i.e.

helmets with low shell aperture helmets including a chin protecting piece also called integral helmets.

The latter, (integral helmets) are much safer and complete with respect to the former, and are necessarily provided with a chin piece or with a collar fitted under the user's jaw and apt to meet, in case of accident, both the purpose to retain the helmet on the user's head thus protecting the wearer's jaw from shock.

The provision of the chin piece or of the collar involves several complications as to construction and a corresponding increase in production costs as said elements must be conceived in such a manner as to allow them to be moved away, to permit insertion and removal of the helmet from the wearer's head.

Up to the present, only solutions involving collars that may be opened horizontally or chin piece that may be lifted are known in the art, but not secured to the wearer's jaw, and therefore require the use of an additional belt to secure the helmet on the wearer's head.

The scope of this invention is to solve the problem in simple and economical manner, by providing a chin piece which really may be secured to the jaw, and therefore apt to provide a true integral helmet that may be lifted or removed, whilst maintaining the possibility to lift the vizor autonomously, ever when the chin piece is lowered, to permit ventilation of the face and head at user's will.

According to this invention, the shell of the helmet is retained on the wearer's head by a chin piece, the structure of which is formed by a single curved element, having side members secured to the shell by lateral pins sliding in shaped slots provided in the shell itself, so as to permit for the chin piece a combined forward shifting and swinging movements which at first frees the chin piece from its engagement under the user's jaw, thereby to permit lifting it to free the low opening of the shell, independently from the vizor which may be totally or partially rotated and lifted on its own pins.

The invention will now be described in conjunction with the annexed drawings by way of example:

In the drawings :

FIG. 1 is a side view, from the right, of the helmet provided with the chin piece according to the invention, shown in closed position.

FIG. 2 is another side view of the helmet of FIG. 1, with the chin piece and vizor in the lifted position.

Figure 3:
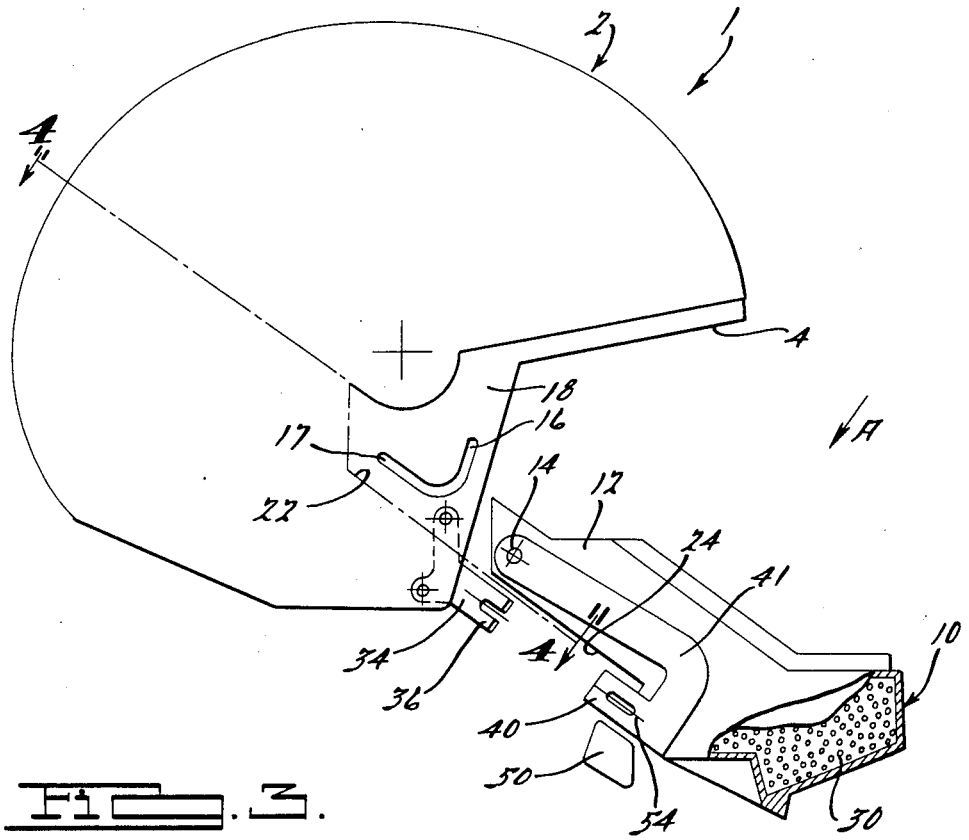
FIG. 3 is an exploded side view of the helmet illustrated in the previous figures, showing a cross section of the chin piece and details of the securing means to the shell.

As shown in the figures, helmet 1 comprises a shell 2, the front opening 4 of which is protected by a vizor 6 made of transparent flexible material. The vizor is rotatable on its own pivots 8, of the known type, and may be lifted independently from chin piece 10.

The chin piece consists of a shaped curved monolithic body, made of stamped plastic material and provided with two side members 12 engaging with the helmet by means of pivots 14. Said pivots run slidably in substantially "L" shaped slots, provided symmetrically on semi walls 18 retained on shell 2 of the helmet. Said semi walls are recessed with respect to surface 20 of shell 2 of the helmet, so that side members 12 of the chin piece are substantially abut with said outer surface 20 of the shell and slidable on walls 18.

The recessed semi walls 18 form an inclined ledge 22 acting as a stop for edge 24 of members 12 of chin piece 10.

It is evident from the above description, that the chin piece , retained with its pivots 14 in shaped slot 16 can perform a swinging movement around the pivots themselves and, successively a forward motion as shown by arrow F in FIG. 2 and vice-versa.

In the lowered position, the forward motion of the chin piece is guided by ledge 22 of the helmet and by pivots 14 engaging in rectilinear tract 17 of slot 16, said tract being parallel to said ledge 22.

A suitable type foam resin padding 30 is fitted inside chin piece 10 as shown in cross section in FIG. 3; the padding is shaped so as to rest against the chin and under the user's jaw when the chin piece is closed in the working position shown in FIG. 1. Said padding is interchangeable and selection of a number of forms adaptable to the user's chin morphology is possible.

Various types of means can be used to secure the chin rest in closed position.

One of these, preferable and advantageous, because of its simplicity is shown in FIGS. 2 to 6.

Figure 5:
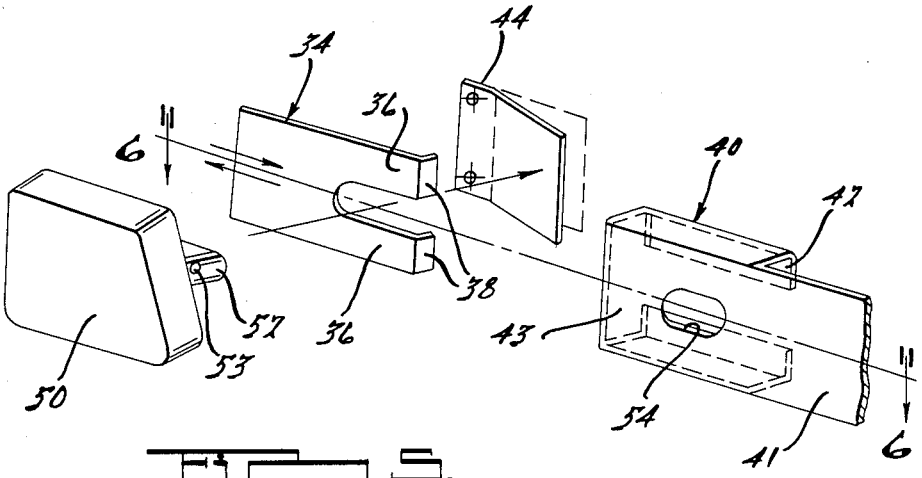
FIG. 5 is an exploded perspective view on an enlarged scale of the means for securing the chin piece to the helmet.
Figure 4:
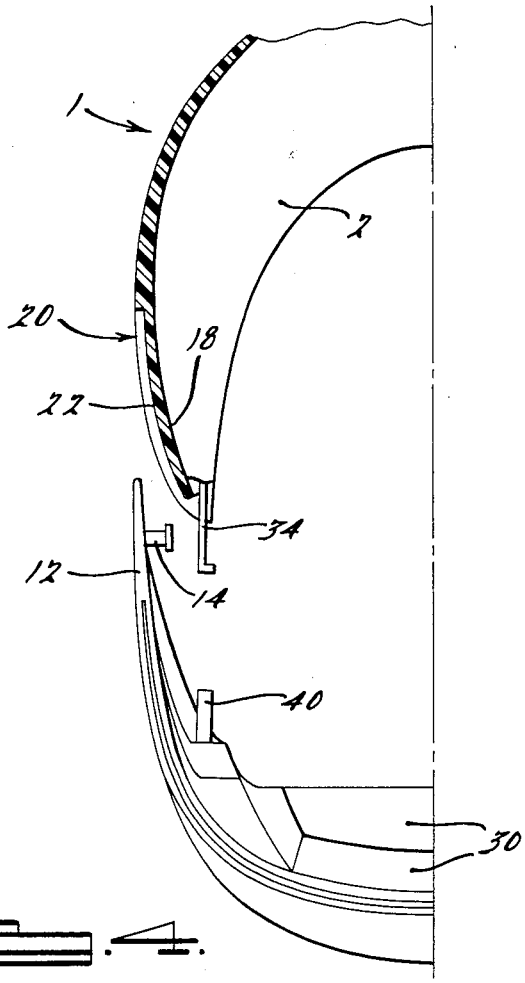
FIG. 4 is a partial view seen from A, of the helmet of FIG. 3, in cross section on line IV—IV of the same figure.
Figure 6:
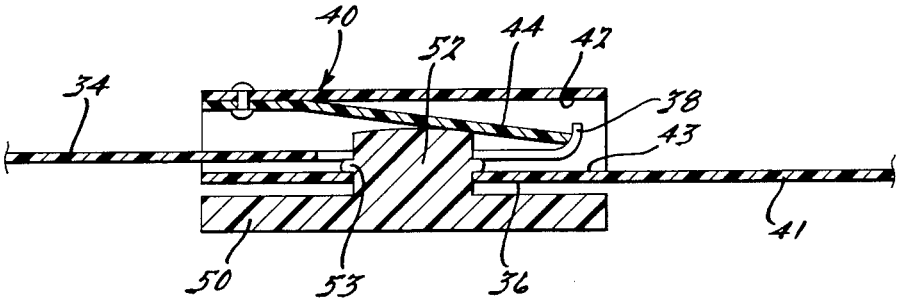
FIG. 6 is section VI—VI of FIG. 5 to show the latching arrangement between the chin piece and the helmet.

A fin 34, preferably metallic, inside the helmet's shell is secured with one end to the wall of the shell, while the projecting free end is divided in two tongues 36 the ends 38 of which are folded over as shown in FIGS. 4 and 5.

Said tongues are joined at both sides of the helmet with a bush 40 secured to the side members of the chin piece integral with a single reinforcement 41 connected to the chin piece in the stamping phase and on which is secured also pivot 14. A metallic lamina 44, elastically inclined toward the external wall of the bush itself is secured to internal wall 42 of the bush 40.

When entering the bush and forcing the elasticity of lamina 44, ends 38 of tongues 36 are blocked by snap action by the edge of the lamina itself, to maintain the chin piece in closed position.

The chin piece is released by depressing a push button 50 on each side (see FIG. 6 in particular) equipped with a push rod 52 that passes in a corresponding hole 54 in wall 43 of bush 40 and through the aperture between tongues 36.

When push buttons 50 are pressed toward the helmet, lamina 44 frees the folded end 38 of fin 34 to permit translatory movement of the chin piece and free the user's jaw from from padding 30 to permit successive lifting of the chin piece with a movement opposite to that shown in FIG. 2. Each push button 50 is secured to the wall 43 of the bush 40 with two lateral projections 53 integral with the push rod 52 and which maintain the push button 50 secured to bush itself.

Lifting by translation and rotation of the chin piece can take place together with the vizor which normally rests on the top edge 56 of the chin piece itself or independently from the vizor swinging on its pivots 8.

As compared to other types of helmets equipped with a fixed collar, the present type of chin piece that can be lifted by forward and swinging movement, makes it possible to provide helmets with a shorter longitudinal size, normally necessary to remove and insert a helmet on the user's head.

Moreover, the arrangement of the disengaging devices described can also conveniently be adopted on chin pieces of limited shape, only to protect the chin and applicable to jet type helmets, to substitute the fastening chin strap.

The connection between the chin piece and the helmet may undergo variations and changes in the context of the inventive idea; for example, the shaped slots 16 may be provided on plates secured to side members 12 of the chin piece while pin 14 may be positioned on the helmet. Moreover adjusting elements for the length of side members 12 may be provided to adapt them to the user's morphology, it being understood that the above variations can be introduced without departing from the spirit and scope of the invention itself.

We claim:

1. Integral helmet provided with a liftable, laterally pivoted vizor, characterized in that the shell of the helmet is secured to the wear's head by means of a chin piece the structure of which is formed by a single curved element the side members of which are slidably hinged by pins in two substantially "L" shaped slots, provided on side walls of the helmet so as to provide for the chin piece an articulation for combined forward shifting and swinging movements in two successive phases; at first the chin piece can be shifted forwards to disengage itself from the wearer's jaw and after it can be lifted to permit removal of the helmet from the user's head or vice versa.

2. Integral helmet according to claim 1, characterized in that a portion of the surface of said side wall of the helmet around said slots is recessed with respect to the outer surface of said shell and forms at its base a ledge acting as a slidable guide for the bottom edge of relevant side members of said chin piece in its forward shifting movement.

3. Integral helmet according to claim 2, characterized in that the longer branch of said substantially "L" shaped slot is generally parallel to said ledge formed by said recessed wall of the helmet in which the slot itself is provided.

4. Integral helmet according to claim 3 characterized in that a removable pad is fitted inside said chin piece, said pad being removable and interchangeable and made of foamed material the form of the pad being such as to be adaptable to the wearer's chin.

5. Integral helmet according to claim 4, characterized in that in its active or closed position said chin piece is secured to the helmet by elements that may be joined by snap action, the first of which being secured inside the helmet shell, while the second is joined to a metal reinforcement incorporated by molding on said body of the chin piece and to which is secured also a pin of the chin rest itself.

6. Integral helmet according to claim 5 characterized in that said helmet includes a restrained locking means comprising a closing element secured to said helmet which is formed by a metal fin, which is split, on its free end, in two tongues each of which terminates with a part folded toward the helmet's interior.

7. Integral helmet according to claim 6, characterized in that said locking means further includes a second element engageable with said fin, said second element including a bush, to the inside wall of which is secured a flexible lamina inclined toward the exterior of the helmet and the free end of which engages with said folded ends of said fin, when said fin is introduced inside said bush.

8. Integral helmet according to claim 7, characterized in that said closing element and said second element of said restrained locking means are disengaged from each other by depressing a relevant push button provided with a push rod passing through an aperture of said bush and through the aperture delimited by said tongues of said element to shift said elastic lamina from its secured position on said ends of said fin.

* * * * *